US007999699B2

(12) United States Patent
Caillaud et al.

(10) Patent No.: US 7,999,699 B2
(45) Date of Patent: Aug. 16, 2011

(54) SYSTEM FOR AIDING THE GUIDANCE OF AN AIRCRAFT ON AN AIRPORT

(75) Inventors: Christophe Caillaud, Blagnac (FR); Guy Deker, Cugnaux (FR); Nicolas Marty, Saint Sauveur (FR)

(73) Assignee: Thales, Neuilly-sur-Seine (FR)

( * ) Notice: Subject to any disclaimer, the term of this patent is extended or adjusted under 35 U.S.C. 154(b) by 490 days.

(21) Appl. No.: 12/134,719

(22) Filed: Jun. 6, 2008

(65) Prior Publication Data

US 2009/0045982 A1 Feb. 19, 2009

(30) Foreign Application Priority Data

Jun. 8, 2007 (FR) ..... 07 04111

(51) Int. Cl.
*G08B 21/00* (2006.01)

(52) U.S. Cl. ..... 340/958; 244/1 R; 340/933; 340/961; 340/972; 340/980

(58) Field of Classification Search ..... 340/945–980, 340/933; 701/3–14, 120, 301; 244/1 R
See application file for complete search history.

(56) References Cited

U.S. PATENT DOCUMENTS

| | | | | |
|---|---|---|---|---|
| 6,405,975 | B1 * | 6/2002 | Sankrithi et al. | 244/1 R |
| 6,694,249 | B1 * | 2/2004 | Anderson et al. | 701/120 |
| 6,731,226 | B2 * | 5/2004 | Walter | 340/972 |
| 6,751,545 | B2 * | 6/2004 | Walter | 701/120 |
| 7,564,372 | B1 * | 7/2009 | Bailey et al. | 340/961 |
| 7,587,278 | B2 * | 9/2009 | Poe et al. | 701/301 |
| 7,737,867 | B2 * | 6/2010 | Arthur et al. | 340/980 |
| 2004/0006412 | A1 * | 1/2004 | Doose et al. | 701/10 |
| 2004/0056952 | A1 * | 3/2004 | Konya | 348/117 |
| 2007/0078591 | A1 | 4/2007 | Meunier et al. | |
| 2007/0078592 | A1 | 4/2007 | Meunier et al. | |

FOREIGN PATENT DOCUMENTS

| | | |
|---|---|---|
| EP | 0901001 | 3/1999 |
| FR | 2888979 | 1/2007 |
| WO | WO03/017226 | 2/2003 |
| WO | WO2006/037402 | 4/2006 |

OTHER PUBLICATIONS

U.S. Appl. No. 12/016,979, filed Jan. 18, 2008, Nicolas Marty et al. (Not Yet Published).

* cited by examiner

*Primary Examiner* — Brent Swarthout
(74) *Attorney, Agent, or Firm* — Lowe Hauptman Ham & Berner, LLP

(57) ABSTRACT

The general field of the invention is that of systems for aiding the guidance of an aircraft on an airport. The system according to the invention comprises means for determining at least one element of the topology of the airport in relation to the position of the aircraft for selecting. Selecting means are provided by the pilot of the aircraft for the element. Generating means are provided to generate at least one guidance or safety set-point using the topological element. Presenting means are provided for the element or the associated set-point on a man-machine interface to the pilot of the aircraft.

14 Claims, 3 Drawing Sheets

SYSTEM FOR AIDING THE GUIDANCE OF AN AIRCRAFT ON AN AIRPORT

RELATED APPLICATIONS

The present application is based on, and claims priority from, French Application Number 07 04111, filed Jun. 8, 2007, the disclosure of which is hereby incorporated by reference herein in its entirety.

FIELD OF THE INVENTION

The field of the invention is that of electronic or optoelectronic devices for aiding aircraft guidance on the ground. It is important that the aircraft ground taxiing phases in an airport can be effected on the one hand in complete safety whatever the air traffic density or the visibility conditions and on the other hand within timescales forecastable by the air traffic control so as to retain mastery of the duration of air journeys and air traffic management. This problem is particularly sensitive in respect of large-capacity civil aeroplanes. This invention thus applies advantageously to large-size civil aircraft of Boeing 747 or Airbus A380 type.

DESCRIPTION OF THE PRIOR ART

On modern aircraft, to ensure the airport navigation function, a system for aiding navigation exists. It comprises notably a so-called Head-down instrument panel display presenting an electronic map of the airport, of the position of the aircraft in the airport and of the trajectory to be followed. This system also comprises management of taxiing authorizations. However, this system alone is not sufficiently precise to ensure a real aircraft guidance function on the runways and taxiways of the airport.

SUMMARY OF THE INVENTION

More precisely, the subject of the invention is a system for aiding the guidance of an aircraft on an airport comprising at least:

- means for determining at least one element of the topology of the airport in relation to the position of the aircraft;
- means for selecting by the pilot of the aircraft the element;
- means for generating at least one guidance set-point using the topological element;
- means for presenting the element or the associated set-point on a man-machine interface to the pilot of the aircraft.

Advantageously, the elements of the topology are either topographic information, or information on the nature or the state of the runway followed by the aircraft, or information on the designation of the runway.

Advantageously, the determining means comprise either a database of airport type or sensors of signs representative of the runway followed by the aircraft or else means for extracting, filtering and recognizing the signs representative of the runway using the data arising from the sensors.

Advantageously, the selecting means comprise a designator of "mouse" or "scroll-pad" type or a selection device which can comprise an integrated display of the selection.

Advantageously, the elements that can be selected arise from elements of the database and the selector comprises means making it possible to indicate the position or the movement to be performed by the aircraft towards the element.

Moreover, the selecting means can comprise means making it possible to engage or to disengage the movement to be performed by the aircraft.

Advantageously, the topography elements are ranked according to an order to be defined by the user according to the use thereof. This order can be alphabetic order or increasing order of distance from the aeroplane of the various elements.

Advantageously, the presentation means comprise:

- either a collimated viewing device of Head-Up display type, the presentations of the topology elements or associated set-points being carried out in at least one specific visual field;
- or a viewing screen called "display", this screen possibly being either the screen termed "Navigation Display" also called "head-level", or the screen termed "Multi Function Display" also called "head-down", the presentations of the topology elements or associated set-points being carried out either in at least one specific window or on a specific page on the screen;
- or a display dedicated to the presentation of the topology elements or associated set-points.

Advantageously, the topology or set-point elements are presented in the form of a symbology of "flight director" type, the presentation of the topology elements or associated set-points being able to be performed simultaneously on at least either the head-up display, or on the viewing screen, or on the dedicated display.

Advantageously, the system is coupled to automatic means for guiding the aircraft on the runway.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious aspects, all without departing from the invention. Accordingly, the drawings and description thereof are to be regarded as illustrative in nature, and not as restrictive.

BRIEF DESCRIPTION OF THE INVENTION

The present invention is illustrated by way of example, and not by limitation, in the figures of the accompanying drawings, wherein elements having the same reference numeral designations represent like elements throughout and wherein.

DETAILED DESCRIPTION OF THE INVENTION

One of the main advantages of the system according to the invention is that it comprises only devices existing on modern craft. It requires only minor modifications of the software for implementing these devices or minor adaptations of the hardware.

Figure 1:
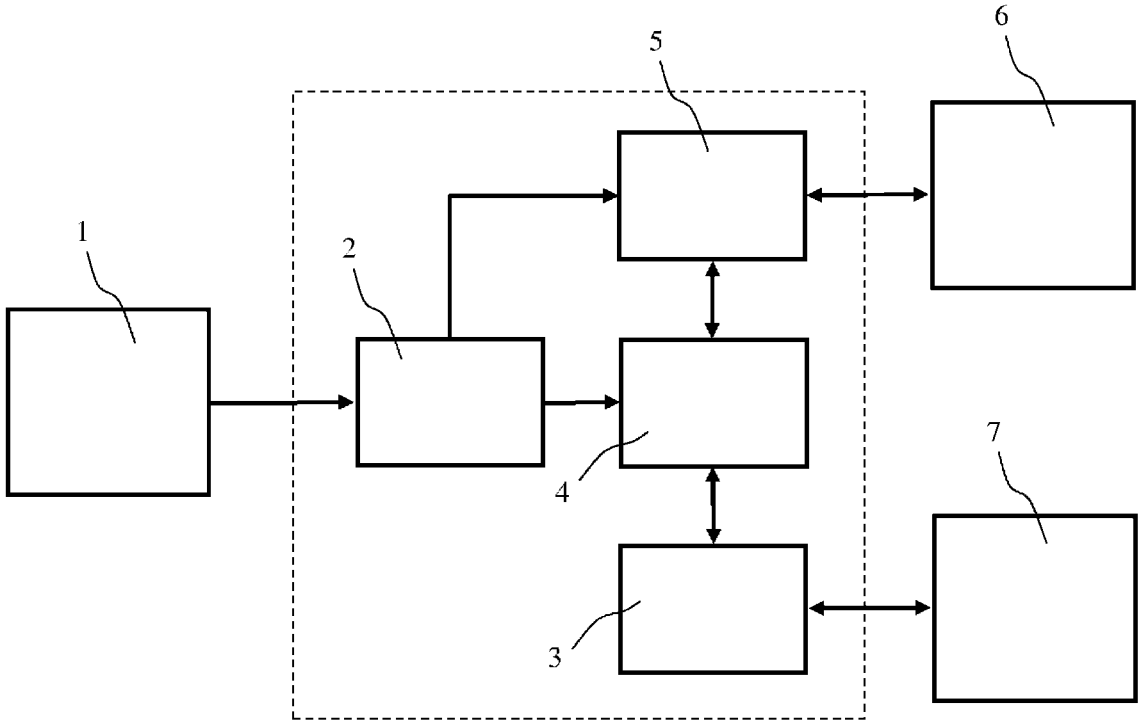
FIG. 1 represents the general schematic of the device according to the invention.

The schematic of the system according to the invention is represented in the dashed rectangle of FIG. 1. Generally, it comprises:

An extractor 2 for extracting data of airport topology elements type, the data originating from a locating system 1;

A selector 4 for selecting the extracted data making it possible to select the topology elements situated in the environment of the aircraft;

The information arising from the selector being transmitted:

on the one hand to means 5 for generating at least one guidance set-point using the topological element, the set-point being transmitted to the guidance system 6;

on the other hand to presentation means 3 associated with a man-machine interface 7.

All these functions can be ensured either by the main navigation system or by a computer dedicated to the airport navigation function.

The topology elements necessary for the guidance that it is sought to identify are essentially marks on the ground comprising indications on the taxiways, runways or parking bays. These indications are essentially topographic data such as the general geometry of the runways, their branch-offs, their lengths, the radii of curvature of the turns, the names associated with these data, etc.

The safety elements that it is sought to identify are, for example, the stop indications or entrances to safety areas, their positionings, their distances from the aircraft, etc. It is possible to couple this information with data on the state of the runway which will depend on the meteorological conditions. These data can condition the authorized speeds of the aircraft, the stopping distances, etc.

The data extraction can be carried out by various devices. By way of first example, the data can originate from the information contained in a database relating to the airport platform on which the aircraft is situated. There are three categories of database giving the description of airports, called "Coarse", "Medium" and "Fine", defined in the document RTCA DO272/EUROCAE ED99, entitled "Users Requirements for Aerodrome Mapping Information". For this type of application, the databases used are of the "Fine" category. Only the data situated in the immediate environment of the craft are then selected.

By way of second example, the data can originate from video images taken by on-board cameras situated on or under the craft associated with automatic recognition devices. They can also arise from active sensors of optical or electromagnetic type. These data are thus filtered and then identified. These techniques are well mastered today.

From the identified data, the selector preserves solely the data useful for the guidance or safety of the craft.

The guidance set-points can be of various categories. Mention will be made of:

taxiing set-points giving the position and the speed of the aircraft on the runway. Thus, it is possible to indicate:

the position deviations of the aircraft with respect to its nominal position;

the speed deviations with respect to a given set-point speed;

the speed margin with respect to the recommended maximum speed which takes account possibly:

of the braking capabilities, so-called anti-sideslip or "anti-skid" level;

and if the item of information is known, of the contamination of the pathway or runway which may be dry, wet, composed of wet snow, dry snow, black ice, etc.

a braking indicator with respect to the next stop or turn;

guidance set-points related to the topology of the airport, without a priori need for an established route. For example, these set-points exhibit in the various displays an item of information of the type: "at the next intersection—to the right, runway 18—to the left, runway 36";

guidance set-points related to an existing route. The objective is to specify which direction the craft has to take as a function of the desired and known destination. For example, the item of information is of the type "at the next intersection, turn right" . . . Implied, "so as to go just where the craft has to go";

distance set-points with respect to the active runway varying according to visibility, daytime or night-time conditions, the presence of fog, etc. . . . , so as to forestall penetration of the regulatory protected space around the runway;

set-points on the operations to be carried out to comply with the potential constraints on an identified element of the airport. For example, the craft approaches an "ILS" zone or a stop indication called a "Stopbar" designated by the interactive device. Then the guidance device proposes the braking set-points necessary to stop at the correct spot, given the speed of movement and the braking capabilities.

Figure 2:
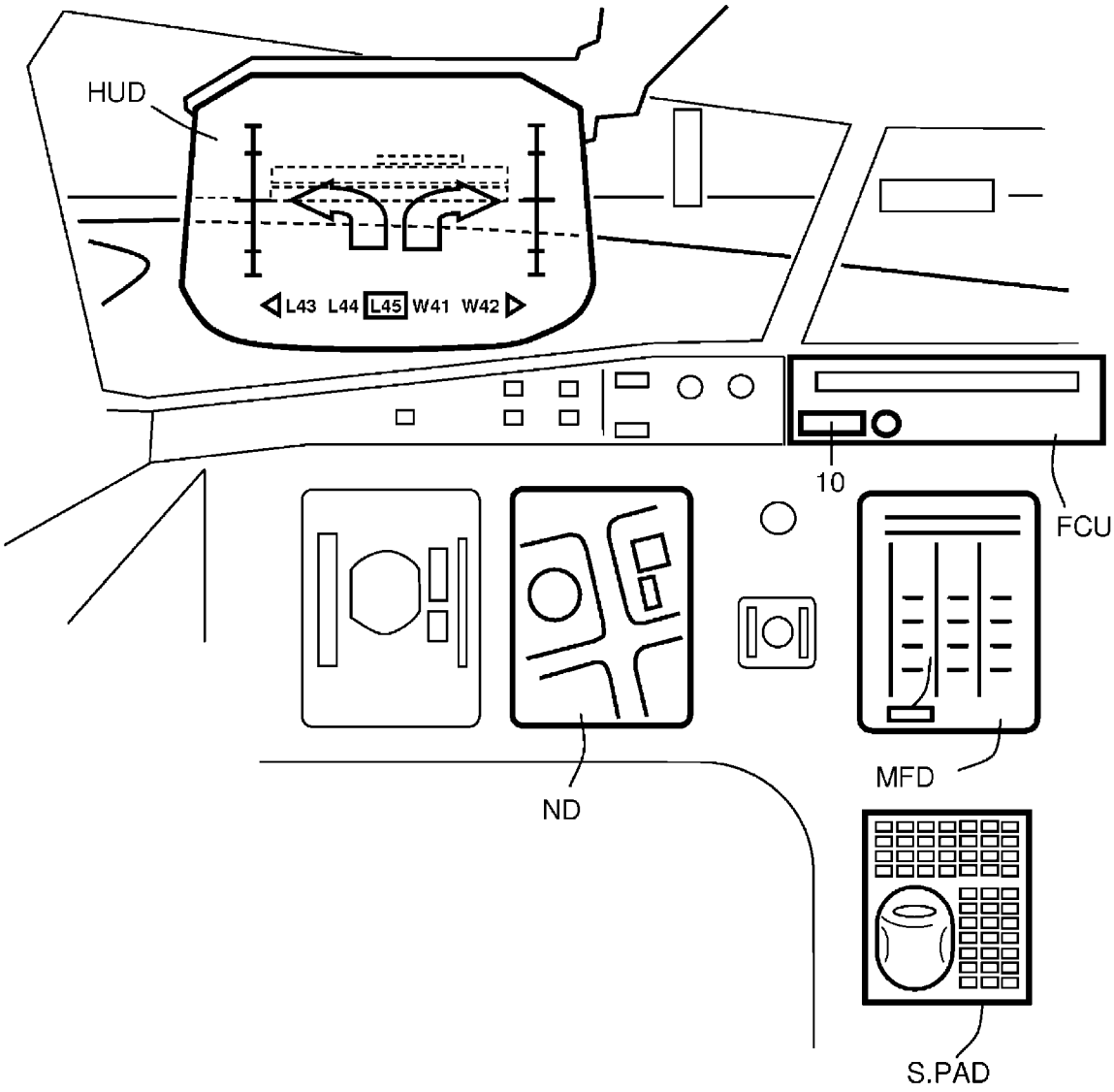
FIG. 2 represents a view of a cockpit wherein are indicated the main devices relevant to the invention.

As illustrated in FIG. 2, the cockpits of modern aircraft comprise man-machine interface systems comprising various viewing and control devices. In this figure, the interfaces relevant to the device according to the invention are in bold. These systems comprise notably:

a Head-Up collimator also called an HUD, the acronym standing for Head-Up Display. A Head-Up collimator conventionally comprises an image source generating the symbology, a collimation optic and an optical combiner placed in the pilot's visual field. The collimator thus gives a virtual image at infinity of the symbology superimposed on the external landscape;

viewers termed Head-down comprising a certain number of liquid crystal viewing screens. Generally, a distinction is made between:

the so-called PFD screen, the acronym standing for "Primary Flight Display" which displays the information necessary for piloting;

the so-called ND screen, the acronym standing for "Navigation Display" which displays the information necessary for navigation;

the so-called MFD screen, the acronym standing for "Multi Function Display" which displays, inter alia, information internal to the craft;

control stations of FCP or FCU type, the acronyms standing for "Flight Control Panel" or "Flight Control Unit";

designators of "computer mouse" type also called "scroll-pads" or "touch-pads".

To guide the aircraft in the airport, the guidance information is preferably displayed in the Head-Up display. Specifically, the Head-Up display possesses very good ergonomics for representing information. Conventionally, the symbols displayed in a Head-Up collimator are separated into two principal categories:

The symbols termed 2D also called non-compliant which provide the pilot with navigation information which is, for example:

A flight director;

the indications of change of direction to be performed by means of arrows. By way of example, the display of FIG. 2 comprises two oppositely directed arrows representing such indications;

the information relating to the runways followed. By way of example, the display of FIG. 2 comprises a horizontal bar comprising 5 identified runway indications, the selected runway denoted "L45" being enclosed in a box.

The symbols termed 3D or compliant which give a better perception of the environment of the aircraft. These symbols are particularly useful in the event of degraded visibility, for example for night-time navigation or in poor meteorological conditions. These are essentially symbols representing the trafficway. The virtual image of this symbology provided by the collimator is superimposed exactly on the real position of the trafficway, the position of the aircraft with respect to the trafficway being fully known to within a meter by means of the navigation systems.

It is also possible to display the guidance information on the so-called ND screen in a dedicated zone as indicated in FIG. 2, it being possible for a representation of the airport to be displayed on this screen or on the so-called MFD screen in a computer page dedicated to this function. This computer page can be organized in various ways. Mention will be made of the structures of drop-down list or so-called "2D" list type. In this case, all the possible options are displayed in the form of a matrix. If the screen has a smaller display size than that of the matrix, it is, of course possible to add indications enabling the undisplayed options to be made to appear.

It is possible to display the guidance set-points in several displays simultaneously so as to make the information secure.

Figure 3:
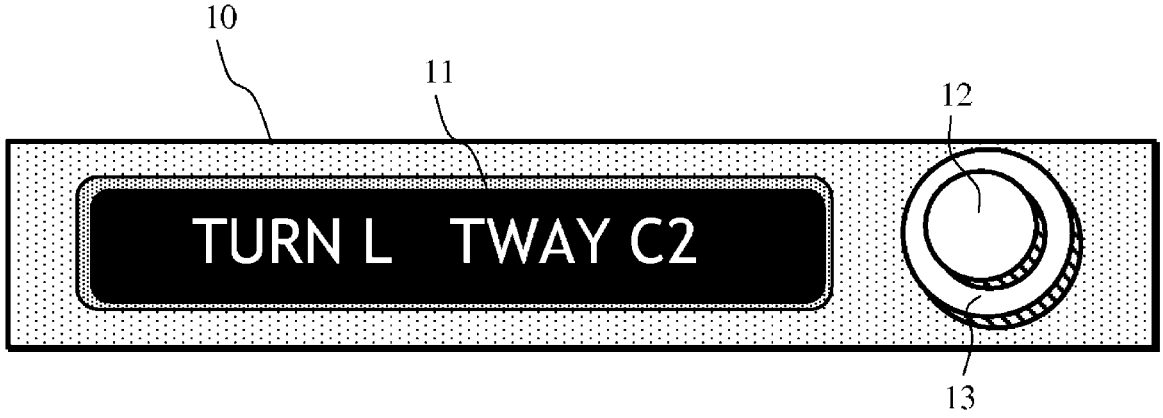
FIG. 3 represents a detailed view of a means for selecting an element of the airport database and an action associated with this element.

It is also possible to display them and select them using a control panel of FCU type comprising a display and a control button 10 that are dedicated to the guidance information. By way of example, FIG. 3 represents a display of this type. The latter device comprises a display 11 and a double rotary selection button. The display can give two items of information, the first relating to the action to be performed by the aircraft and the second the element concerned. The button can comprise two rotary buttons 12 and 13 of different diameter and mounted on a common axis. The lower rotary button 13 allows, for example, the selection of an element of the airport topography in the database. The upper rotary button 12 makes it possible to select an elementary action such as "TURN L" to turn left as indicated in FIG. 3, or "HOLD POS AT" or "STOP AT" to stop the aircraft. Furthermore, the same double rotary button can be used to engage the action, for example by pushing the upper button or to stop/disengage the action, for example, by pulling the upper button.

The selecting means can comprise:

a designator of "mouse" or "scroll-pad" type. In this case, selection can be performed either by using the thumbwheel of the mouse or a "rotator" making it possible to point and to select the various guidance options, or by using the pointer of the mouse;

selection buttons disposed on the control panels;

a touch screen disposed on the ND or MFD screens.

The designation and selection time for the guidance set-point adopted is an important factor insofar as the user may need to react fast. So, it is advantageous to favour designators that allow fast designation such as touch screens.

There are three guidance levels depending on the complexity and sophistication of the guidance calculations performed by the onboard computers.

The first guidance level consists in displaying the deviations in geometric position with respect to the trajectory or to the ideal position or the speed deviations with respect to a set-point speed. The pilot acts on the controls so as to reset the aircraft on its trajectory.

The second guidance level consists in indicating to the pilot what he must do to return to the correct trajectory.

The third guidance level consists in ensuring the guidance function in an entirely automatic manner by the automatic pilot which will control the nose steering gear, the thrust control systems for the engines also called ATHR, the acronym standing for "AutoTHRust" and the control systems for the brakes also called BSCU, the acronym standing for Brake Steering and Control Unit.

It will be readily seen by one of ordinary skill in the art that the present invention fulfils all of the objects set forth above. After reading the foregoing specification, one of ordinary skill in the art will be able to affect various changes, substitutions of equivalents and various aspects of the invention as broadly disclosed herein. It is therefore intended that the protection granted hereon be limited only by definition contained in the appended claims and equivalents thereof.

The invention claimed is:

1. A system for aiding guidance of an aircraft on an airport comprising:

means for determining at least one topology element of the airport in relation to a position of the aircraft, said determining means including on-board cameras situated on or under the aircraft associated with automatic recognition devices or active sensors of signs representative of a runway followed by the aircraft, said active sensors of optical or electromagnetic type;

an airport-type database;

means for selecting by a pilot of aircraft said topological element;

means for generating at least one guidance or safety set-point by using the topological element; and means for presenting said topological element or the associated set-point on a man-machine interface to the pilot of the aircraft.

2. The system according to claim 1, wherein the topology elements are either topographic information, or information on the nature or the state of the runway followed by the aircraft, or information on the designation of the runway.

3. The system according to claim 1, wherein the determining means comprise means for extracting, filtering and recognizing the signs representative of the runway in the database using the data arising from the on-board cameras or the sensors.

4. The system according to claim 1, wherein the selecting means comprise a designator of "mouse" or "scroll-pad" type or a selection button of the selector/rotator type.

5. The system according to claim 4, wherein the selecting means comprise selection display means.

6. The system according to claim 5, wherein the topology elements being selected arise from elements of the database and that the selector comprises means for indicating the position or the movement to be performed by the aircraft towards the element.

7. The system according to claim 6, wherein the selecting means comprise means for engaging or disengaging the movement to be performed by the aircraft.

8. The system according to claim 4, wherein the elements are disposed in a list and ranked in an order of priority configurable, which order of priority is an alphabetic order or a ranking of the elements as a function of distance of the elements with respect to the aeroplane.

9. The system according to claim 1, further comprising presentation means which include a collimated viewing device of Head-Up display type, the presentations of the topology elements or associated set-points being carried out in at least one specific visual field.

10. The system according to claim 1, further comprising presentation means which include a viewing screen called "display", said screen being either the screen termed "Navigation Display", or the screen termed "Multi Function Display", the presentations of the topology elements or associated set-points being carried out either in at least one specific window or on a specific page on the screen.

11. The system according to claim 9, wherein the topology or set-point elements are presented in the form of a symbology of "flight director" type.

12. The system according to claim 1, further comprising presentation means which include a display dedicated to the presentation of the topology elements or associated set-points.

13. The system according to claim 9, wherein the presentation of the topology elements or associated set-points is performed simultaneously on at least either the head-up display, or on the viewing screen, or on the dedicated display.

14. The system according to claim 1, wherein said system is coupled to automatic means for guiding the aircraft on the runway.

* * * * *